US008646465B2

(12) United States Patent
Tam

(10) Patent No.: US 8,646,465 B2
(45) Date of Patent: Feb. 11, 2014

(54) HAIR STYLING APPARATUS AND METHOD

(75) Inventor: Ka Yan Connie Tam, Hong Kong (CN)

(73) Assignee: Sun Luen Electrical Manufacturing Co. Ltd., Hong Kong (CH)

( * ) Notice: Subject to any disclaimer, the term of this patent is extended or adjusted under 35 U.S.C. 154(b) by 58 days.

(21) Appl. No.: 13/147,706

(22) PCT Filed: Nov. 17, 2009

(86) PCT No.: PCT/CN2009/074970

§ 371 (c)(1),
(2), (4) Date: Aug. 3, 2011

(87) PCT Pub. No.: WO2011/060569

PCT Pub. Date: May 26, 2011

(65) Prior Publication Data

US 2011/0284020 A1 Nov. 24, 2011

(51) Int. Cl.

| | |
|---|---|
| ***A45D 7/02*** | (2006.01) |
| ***A45D 6/08*** | (2006.01) |
| ***A45D 6/18*** | (2006.01) |
| ***A45D 2/00*** | (2006.01) |
| ***A45D 2/14*** | (2006.01) |
| ***A45D 2/12*** | (2006.01) |
| ***A45D 1/02*** | (2006.01) |
| ***A45D 2/22*** | (2006.01) |
| ***A45D 1/04*** | (2006.01) |
| ***A45D 2/36*** | (2006.01) |
| ***A45D 4/06*** | (2006.01) |
| ***A45D 4/12*** | (2006.01) |

(52) U.S. Cl.

USPC ..... 132/211; 132/236; 132/223; 132/226; 132/227; 132/268; 219/222; 219/225

(58) Field of Classification Search

USPC ..... 132/236, 211, 227, 243, 229, 232, 240, 132/241, 268, 271, 200, 207, 210, 273, 212, 132/223, 65.1, 226, 230, 266, 269, 237, 132/225, 228, 235, 245, 250, 252–255, 132/224; 219/222, 225, 226, 227, 229, 228; 34/96, 283; 392/383, 384, 379, 380, 392/385; 24/331, 334, 374, 133, 115 M; 126/408; 226/128, 129

See application file for complete search history.

(56) References Cited

U.S. PATENT DOCUMENTS

| | | | | |
|---|---|---|---|---|
| 1,377,655 | A * | 5/1921 | Begas | 132/229 |
| 1,709,918 | A * | 4/1929 | Santurello | 132/266 |
| 1,901,430 | A * | 3/1933 | Bjorkman | 132/266 |

(Continued)

FOREIGN PATENT DOCUMENTS

FR 2628611 A 9/1989

OTHER PUBLICATIONS

International Search Report, for PCT/CN2009/074970, mailed Jul. 29, 2010, (3 pages).

*Primary Examiner* — Vanitha Elgart

(74) *Attorney, Agent, or Firm* — William J. Sapone; Ware Fressola Maguire & Barber LLP

(57) ABSTRACT

A hair styling apparatus (10) is disclosed as including a heating barrel (20) and a protecting sleeve (28) which covers part of the heating barrel, the protective sleeve including a wall (30) with a helical slot (32) allowing a tress of hair to be received through the slot to contact the heating barrel.

20 Claims, 11 Drawing Sheets

(56) References Cited

U.S. PATENT DOCUMENTS

| | | | | | |
|---|---|---|---|---|---|
| 1,905,373 | A | * | 4/1933 | Duraney | 132/266 |
| 2,423,252 | A | * | 7/1947 | Nemeth | 132/250 |
| 3,312,128 | A | * | 4/1967 | Wasson | 81/487 |
| 3,918,465 | A | * | 11/1975 | Barradas | 132/232 |
| 4,034,201 | A | * | 7/1977 | Walter et al. | 219/222 |
| 4,267,851 | A | * | 5/1981 | Plaisted | 132/229 |
| 4,354,092 | A | * | 10/1982 | Manabe et al. | 219/225 |
| 4,411,281 | A | * | 10/1983 | Doern | 132/229 |
| 4,602,143 | A | * | 7/1986 | Mack et al. | 219/225 |
| 4,623,779 | A | * | 11/1986 | Raab | 219/222 |
| 4,858,810 | A | * | 8/1989 | Intlekofer et al. | 226/127 |
| 4,866,249 | A | * | 9/1989 | Howard | 219/225 |
| 4,939,340 | A | * | 7/1990 | Brill | 219/225 |
| 5,046,516 | A | * | 9/1991 | Barradas | 132/232 |
| 5,119,847 | A | * | 6/1992 | Powell et al. | 132/226 |
| 5,159,861 | A | * | 11/1992 | Anderson | 81/487 |
| 5,810,026 | A | * | 9/1998 | Sham | 132/232 |
| 5,944,030 | A | * | 8/1999 | Kelsey | 132/252 |
| 5,983,903 | A | | 11/1999 | Namba et al. | |
| 6,352,080 | B1 | * | 3/2002 | Neville | 132/233 |
| 7,082,949 | B2 | | 8/2006 | Julemont | |
| 7,481,228 | B2 | | 1/2009 | Ragosta et al. | |
| 2001/0013513 | A1 | * | 8/2001 | Chan | 219/225 |
| 2003/0000542 | A1 | * | 1/2003 | Huntley | 132/232 |
| 2007/0278205 | A1 | * | 12/2007 | Pencook | 219/222 |
| 2010/0263684 | A1 | * | 10/2010 | De Benedictis | 132/272 |

* cited by examiner

HAIR STYLING APPARATUS AND METHOD

TECHNICAL FIELD

This invention relates to a hair styling apparatus, in particular an apparatus for styling hair by heating, and a method of styling hair.

BACKGROUND

There are in existence various hair styling apparatus such as hair curlers. In a conventional hair curler, tresses of hair are wound around a heating barrel. A user may then press a button to pass electricity to the heating barrel to heat up the barrel, so as to curl the hair by heating. In order to curl the hair, the heating barrel has to be heated up to a very high temperature. It is well known that it is dangerous to operate such an apparatus, whether to the user or to the one whose hair is being styled.

SUMMARY OF THE INVENTION

It is thus an object of the present invention to provide a hair styling apparatus and a method of styling hair in which the aforesaid shortcoming is mitigated or at least to provide a useful alternative to the public. In particular, it is an object of the present invention to provide a hair styling apparatus and a method of styling hair in which the danger of the user being hurt during use is reduced.

According to a first aspect of the present invention, there is provided a hair styling apparatus including at least one heating member, characterized in including at least one sleeve member covering part of said heating member, said sleeve member including a wall member with at least one helical slot allowing a tress of hair to be received through said slot to contact said heating member.

According to a second aspect of the present invention, there is provided a hair styling method including steps of (a) providing a hair styling apparatus with at least one heating member and at least one sleeve member covering part of said heating member, wherein said sleeve member includes a wall member with at least one helical slot; (b) engaging a tress of hair with said hair styling apparatus; and (c) rotating said hair styling apparatus to thereby wind said tress of hair onto said heating member along said helical slot of said wall member of said sleeve member.

BRIEF DESCRIPTION OF THE DRAWINGS

A hair styling apparatus according to an embodiment of the present invention will now be described, by way of example only, with reference to the accompanying drawings in which.

DETAILED DESCRIPTION OF THE INVENTION

An electric hair curler according to an embodiment of the present invention is shown in FIGS. 1 to 7, and generally designated as 10. For clarity reason, a protective sleeve of the hair curler 10 is not shown in FIGS. 1 to 7.

Figures 1, 3, 5, 6:
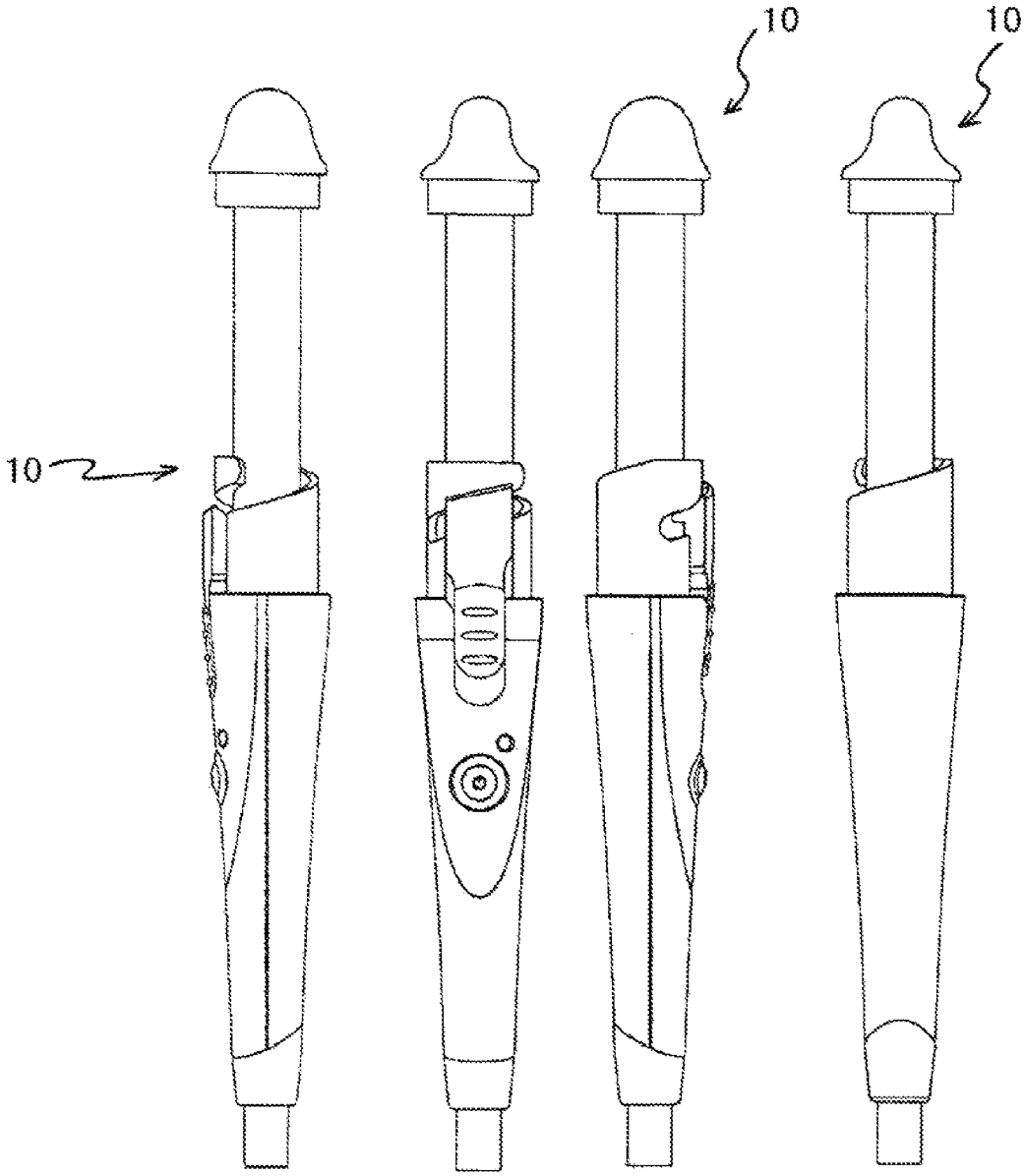
FIG. 1 is a right side view of a hair styling apparatus according to an embodiment of the present invention, without a protecting sleeve.
FIG. 3 is a front view of the apparatus of FIG. 1.
FIG. 5 is a left side view of the apparatus of FIG. 1.
FIG. 6 is a rear view of the apparatus of FIG. 1.
Figure 2:
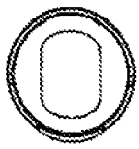
FIG. 2 is a top view of the apparatus of FIG. 1.
Figure 4:
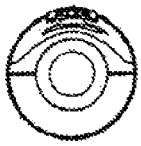
FIG. 4 is a bottom view of the apparatus of FIG. 1.
Figure 7:
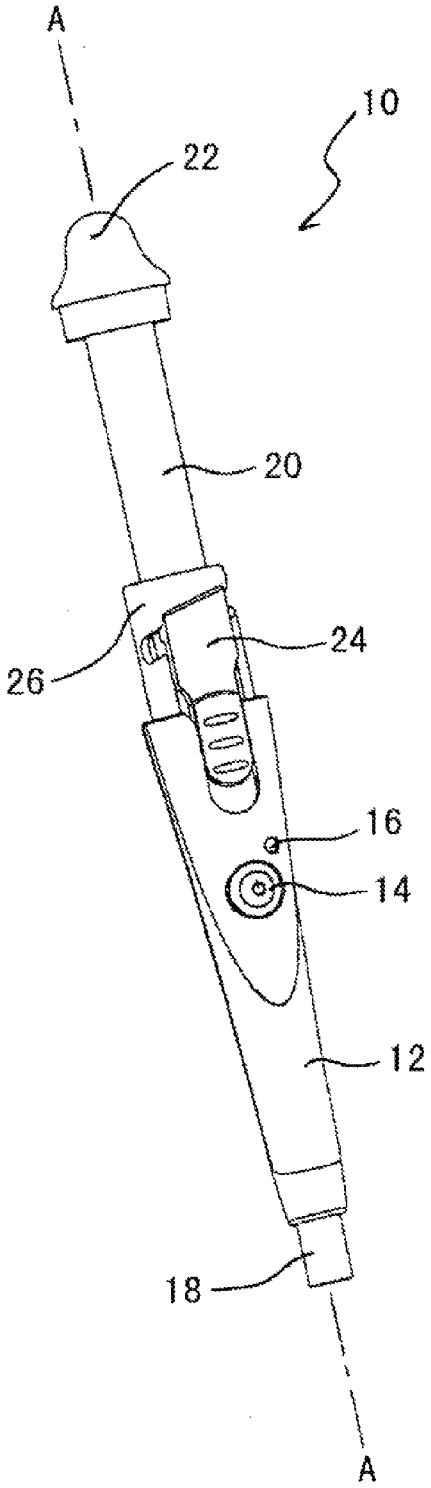
FIG. 7 is a perspective view of the apparatus of FIG. 1.
Figure 8:
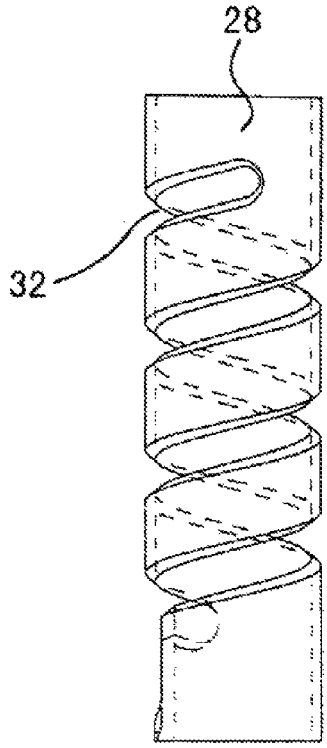
FIG. 8 is a right side view of a protecting sleeve of the hair styling apparatus of FIG. 1.
Figure 9:
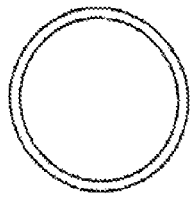
FIG. 9 is a top view of the protecting sleeve of FIG. 8.
Figure 10:
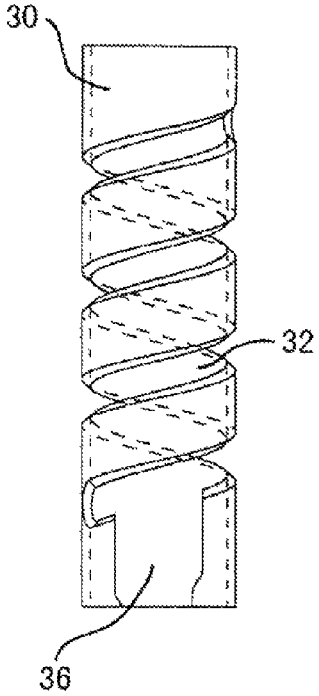
FIG. 10 is a front view of the protecting sleeve of FIG. 8.
Figure 12:
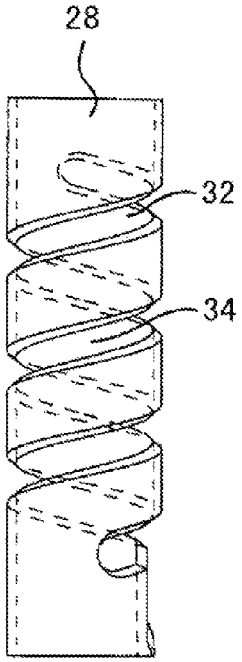
FIG. 12 is a left side view of the protecting sleeve of FIG. 8.
Figure 13:
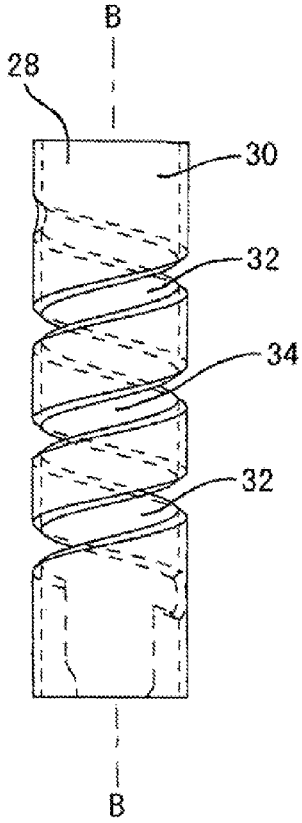
FIG. 13 is a rear view of the protecting sleeve of FIG. 8.
Figure 11:
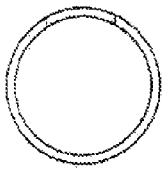
FIG. 11 is a bottom view of the protecting sleeve of FIG. 8.
Figure 14:
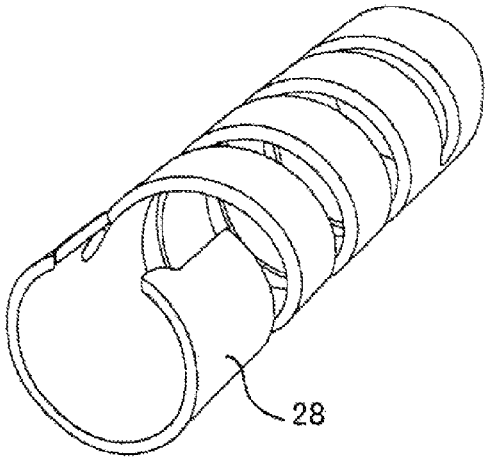
FIG. 14 is a perspective view of the protecting sleeve of FIG. 8.
Figure 15:
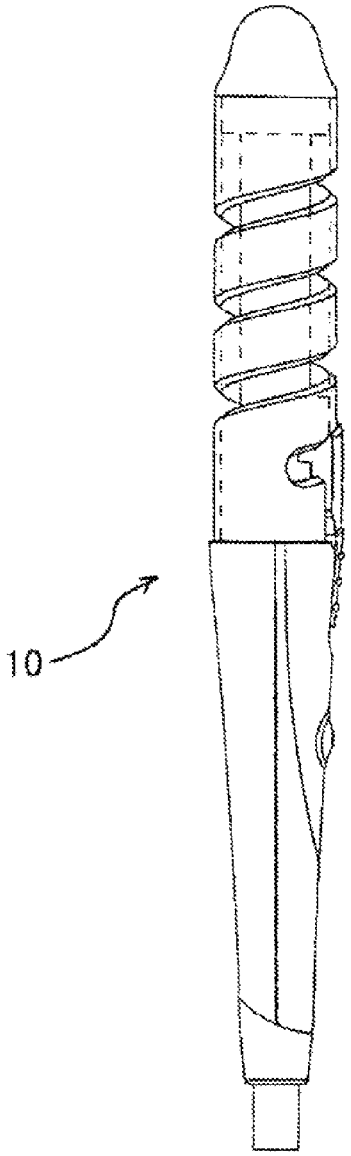
FIG. 15 is a left side view of the hair styling apparatus of FIG. 1 with the protecting sleeve.
Figure 17:
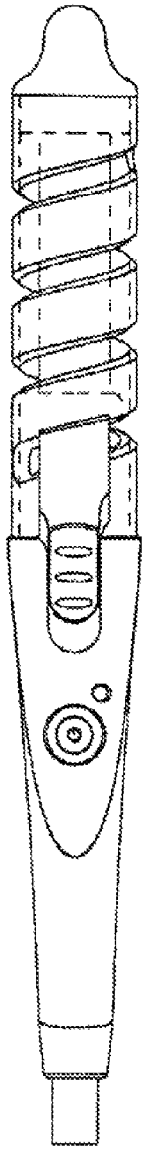
FIG. 17 is a front view of the apparatus of FIG. 15.
Figure 19:
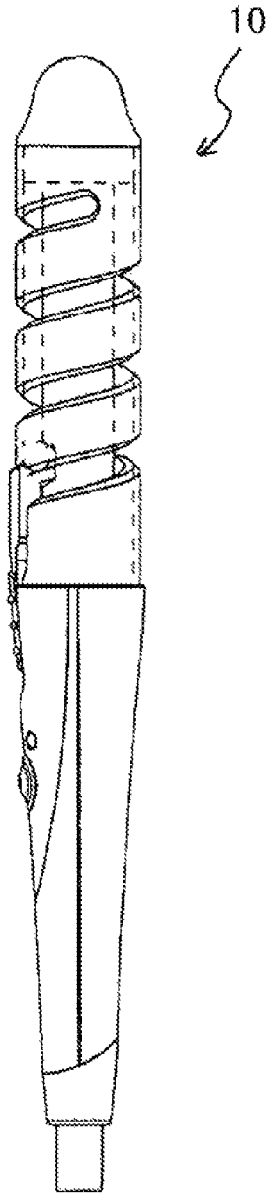
FIG. 19 is a right side view of the apparatus of FIG. 15.
Figure 16:
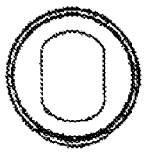
FIG. 16 is a top view of the apparatus of FIG. 15.
Figure 18:
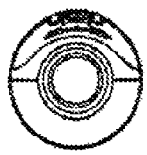
FIG. 18 is a bottom view of the apparatus of FIG. 15.
Figure 20:
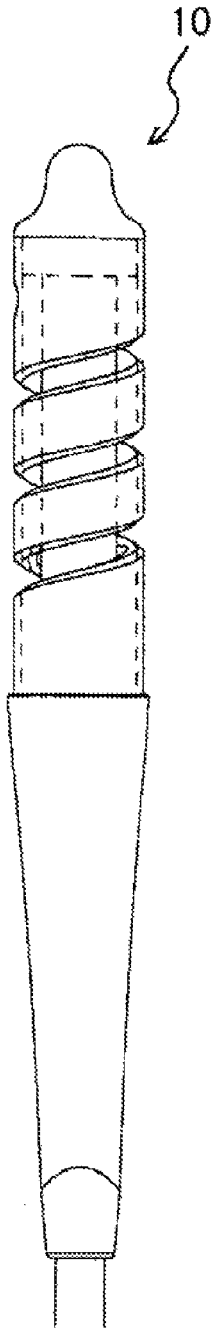
FIG. 20 is a rear view of the apparatus of FIG. 15.
Figure 21:
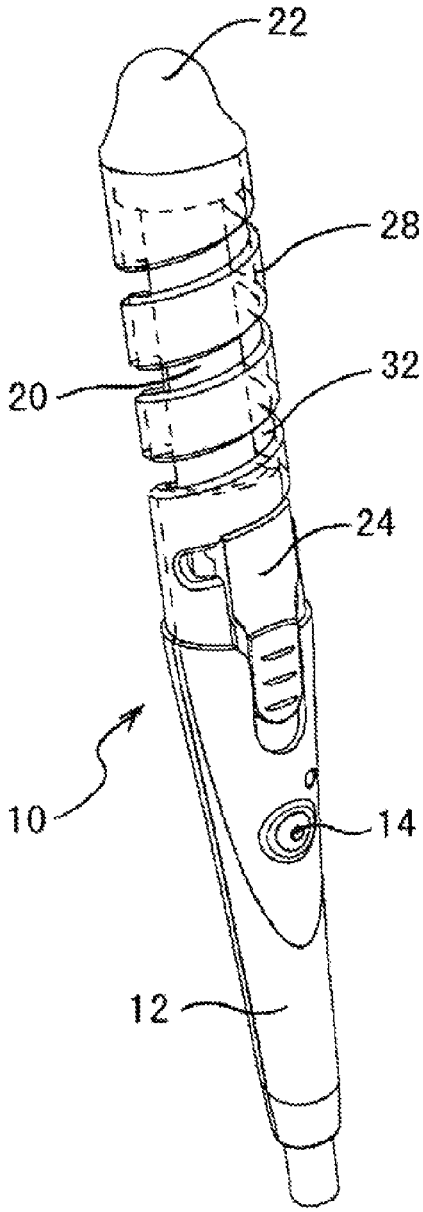
FIG. 21 is a perspective view of the apparatus of FIG. 15.

As shown more clearly in FIG. 7, the hair curler 10 has an elongate handle 12 with a switch 14 for controlling on and off of the hair curler 10. A light 16 is provided for signifying whether the hair curler 10 has been switched on. A first longitudinal end of the handle 12 is joined with an electric cable 18 for providing electricity to the hair curler 10. An opposite second longitudinal end of the handle 12 is fixed with an elongate cylindrical heat conducting heating barrel 20. In use, when the hair curler 10 is switched on, the heating barrel 20 is heated by an electric heater (to be discussed below) to a very high temperature, such that tresses of hair wound around the heating barrel 20 may be styled, shaped and, particularly, curled. A cool tip 22 made of a non-heat conducting material is provided at a free end of the heating barrel 20. A user may hold the cool tip 22 with his/her fingers for better manipulation of the hair curler 10.

At the portion adjoining the handle 12 and the heating barrel 20 are provided a sliding lock 24 and a base 26, forming a locking mechanism, the purpose of which will be discussed below.

FIGS. 9 to 14 show various views of a protecting sleeve 28 of the hair curler 10. The protecting sleeve 28 is non-opaque (e.g. transparent or translucent), and is made of a polycarbonate plastic. The protecting sleeve 28 is in the shape of a hollow cylinder with a circular wall 30 on which a helical slot 32 is provided. In particular, the helical slot 32 curves along a majority of the length of the wall 30 of the protecting sleeve 28 from adjacent a first longitudinal end to adjacent an opposite second longitudinal end of the protecting sleeve 28. By way of such an arrangement, it is possible to access the interior space 34 of the protecting sleeve 28 from outside of the wall 30 through the helical slot 32, but the size of the slot 32 is such that it does not allow a user's finger to pass through. During operation of the hair curler 10, the temperature of the outer surface of the wall 30 of the protecting sleeve 28 rises to a temperature which is not high enough to hurt the user.

One of the longitudinal ends of the protecting sleeve 28 is provided with an opening 36, which leads to and communicates with the slot 32, and is shaped and configured to fit and correspond with the sliding lock 24 and base 26.

Turning to FIGS. 15 to 21, such show various views of the hair curler 10 fixedly installed with the protecting sleeve 28. In particular, the protecting sleeve 28 is fixed relative to the heating barrel 20, e.g. by a number of screws (not shown). When the protecting sleeve 28 is installed to the hair curler 10, a central longitudinal axis B-B (see FIG. 13) of the protecting sleeve 28 is parallel to or coincides with a central longitudinal axis A-A (see FIG. 7) of the hair curler 10.

When so installed, the protecting sleeve 28 is spaced apart from and covers a major part of the circular surface of the heating barrel 20. It is possible to access and contact the heating barrel 20 through the helical slot 32. It can also be seen that, when so installed, a free end of the sliding lock 24 is received in the opening 36 of the protecting sleeve 28.

Figure 22:
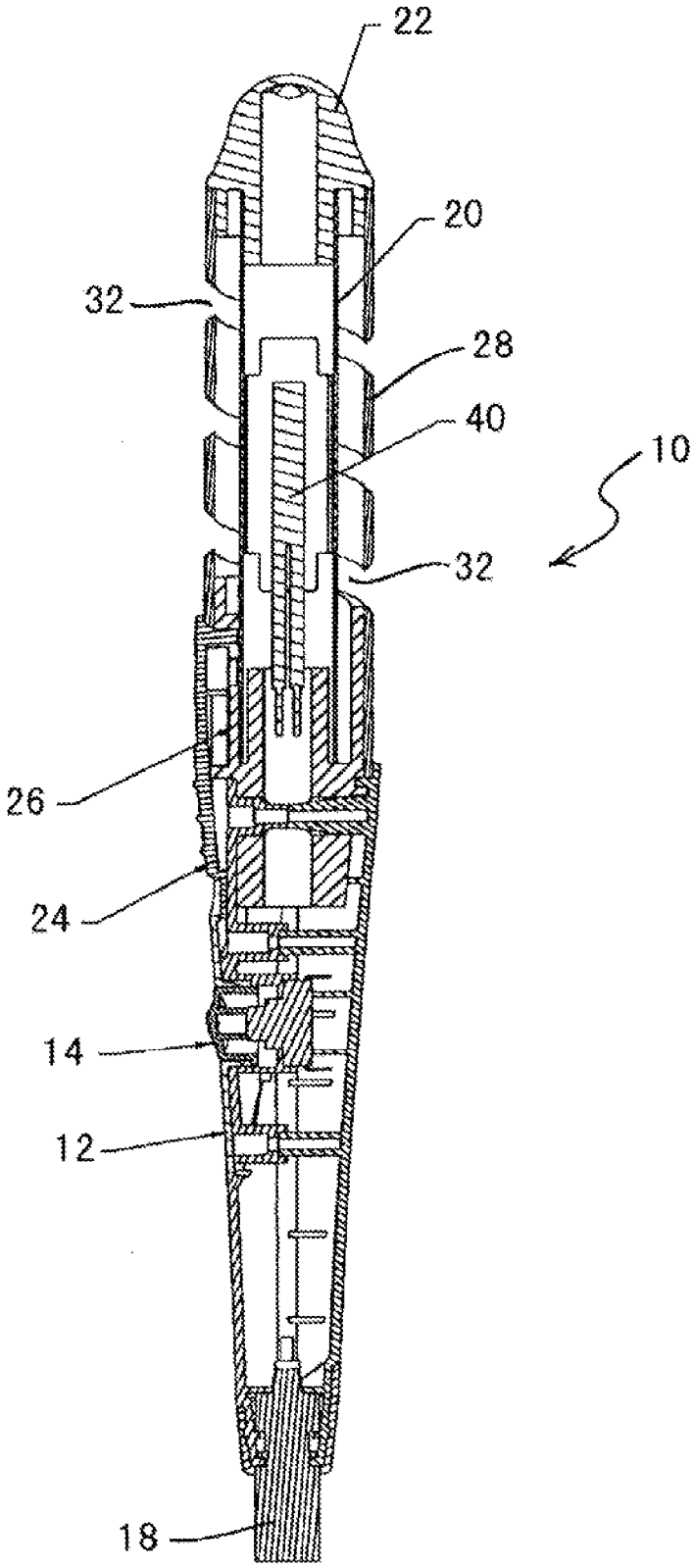
FIG. 22 is a longitudinal sectional view of the apparatus of FIG. 15.

As shown in FIG. 22, an electric heater 40 is provided within and in contact with the heating barrel 20. When the electric heater 40 is heated up by passing through an electric current, it heats up the heating barrel 20.

Figure 24:
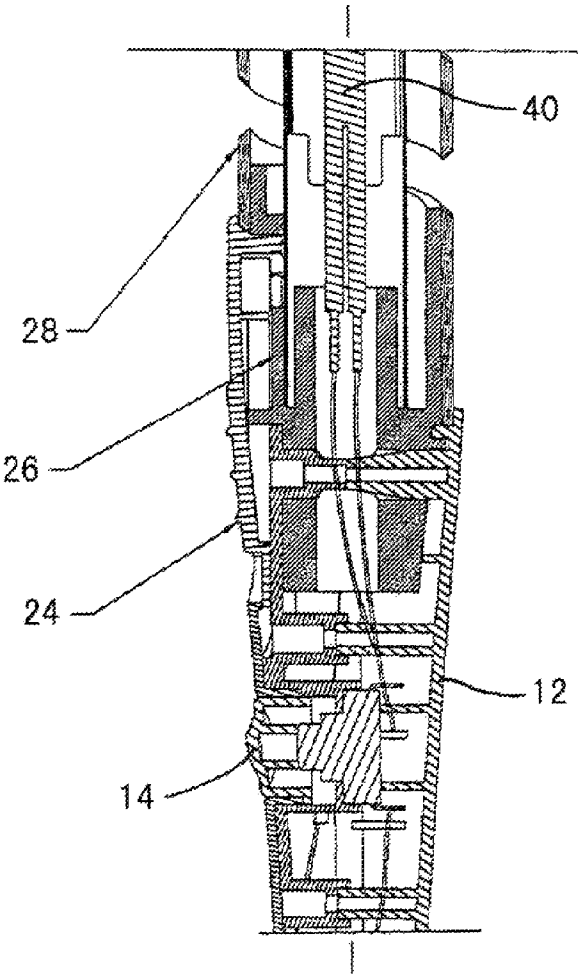
FIG. 24 is an enlarged partial longitudinal sectional view of the apparatus of FIG. 23 with the locking mechanism in a closed configuration.
Figure 23:
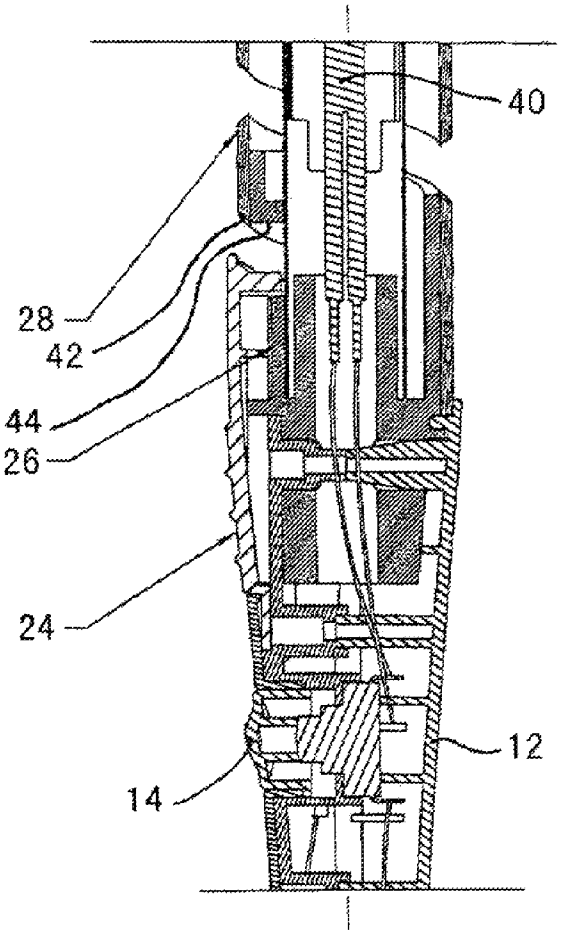
FIG. 23 is an enlarged partial longitudinal sectional view of the apparatus of FIG. 15 with the locking mechanism in an open configuration.

Turning now to FIGS. 23 and 24, such shows movement of the sliding lock 24 relative to the handle 12, the base 26 and the protecting sleeve 28. In particular, the sliding lock 24 is slidable relative to the handle 12, the base 26 and the protecting sleeve 28 along a path generally parallel to the central longitudinal axis A-A of the hair curler 10 between the position shown in FIG. 23 (in which the locking mechanism including the lock 24 and the base 26 is in an open configuration) and the position shown in FIG. 24 (in which the locking mechanism including the lock 24 and the base 26 is in a closed configuration). When the sliding lock 24 is in the position shown in FIG. 23, the distal end of the sliding lock 24 is out of contact with a surface 42 adjacent the opening 36 of the protecting sleeve 28 and a surface 44 of the base 26. When the sliding lock 24 is in the position shown in FIG. 24, the distal end of the sliding lock 24 is in contact with the surface 42 adjacent the opening 36 of the protecting sleeve 28 and the surface 44 of the base 26. The sliding lock 24 is biased, e.g. by a spring (not shown), towards the position shown in FIG. 24.

Such an arrangement enables part of a tress of hair to be releasably fixed relative to the protecting sleeve 28. In particular, part of a tress of hair may be releasably held by and between the sliding lock 24 on the one hand and the base 26 and the protecting sleeve 28 on the other hand.

Figure 25:
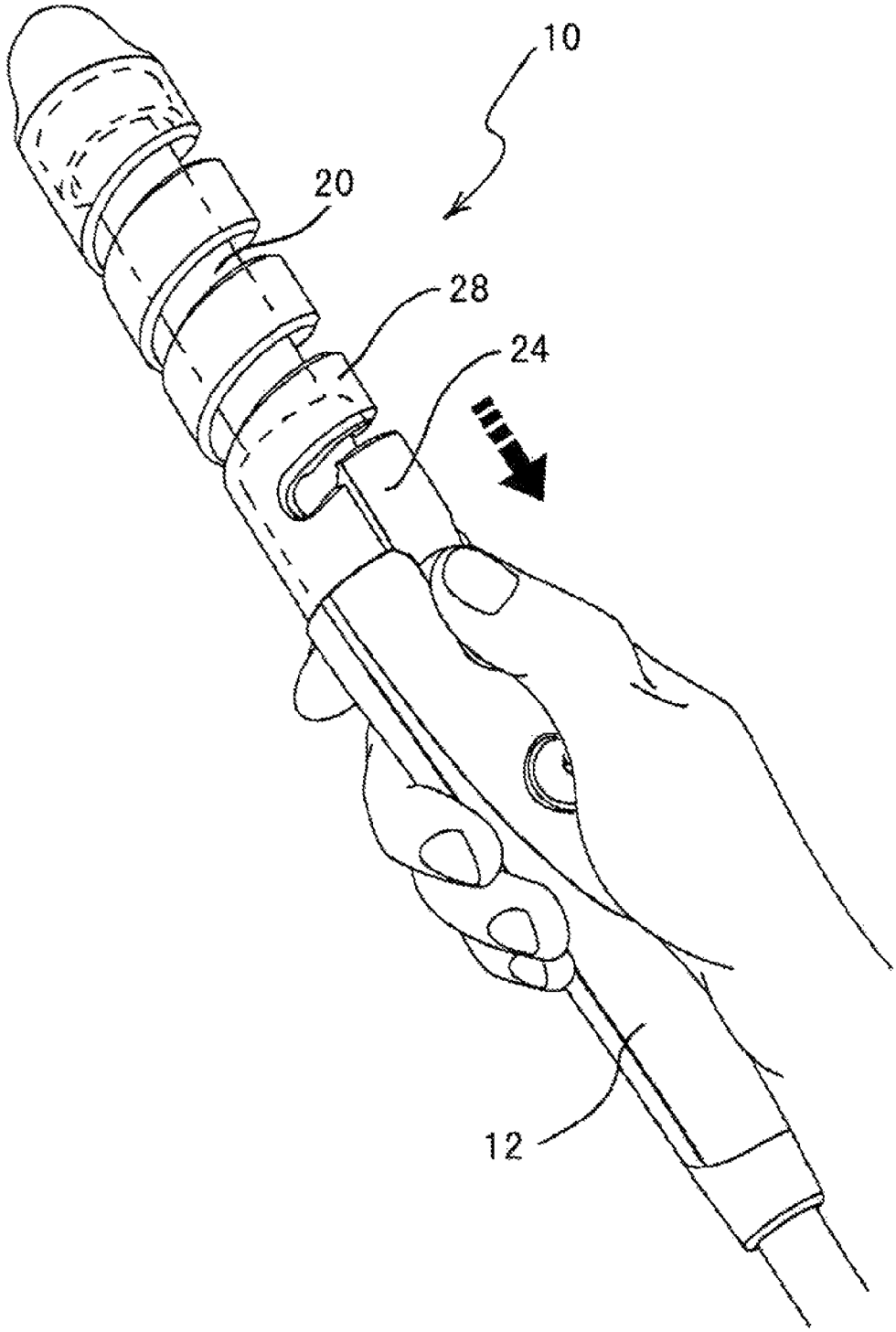
FIGS. 25 to 27 show steps of releasing fixing a tress of hair to the apparatus of FIG. 15.
Figure 26:
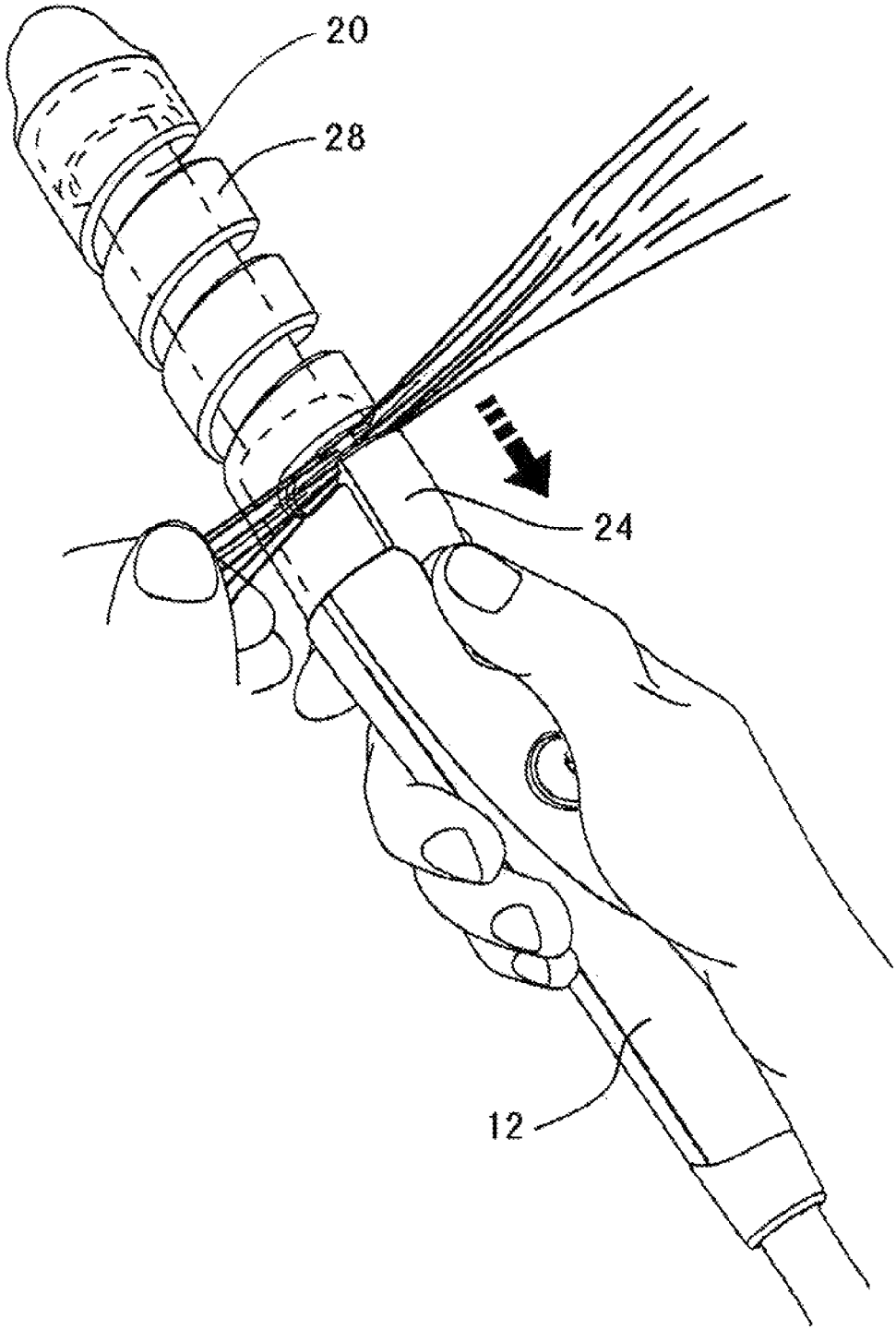

FIGS. 25 to 28 show a way of styling hair (in particular curling hair) by using the hair curler 10. Upon being provided with the hair curler 10, a user holding the handle 12 may, as shown in FIG. 25, use his/her thumb to move the sliding lock 24 away from the protecting sleeve 28, as shown in the direction of the arrow shown in FIG. 25. Subsequently, and as shown in FIG. 26, part of a tress of hair is inserted through the space between the sliding lock 24 on the one hand and the protecting sleeve 28 and the base 26 on the other hand.

Figure 27:
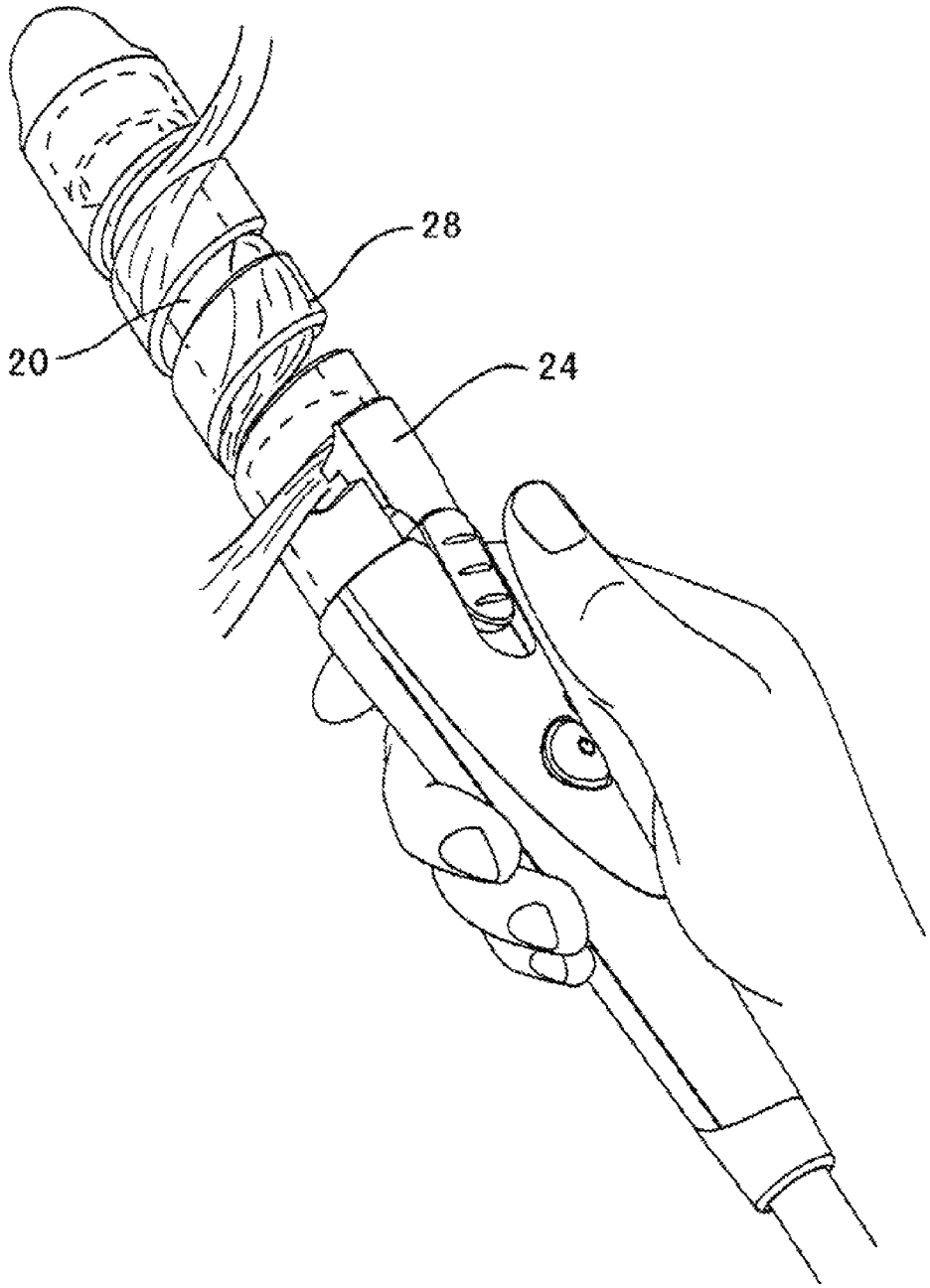

As shown in FIG. 27, when the user releases the sliding lock 24, because of the biasing force on the sliding lock 24, the sliding lock 24 moves towards the protecting sleeve 28 so as to releasably hold and fix the part of tress of hair between the sliding lock 24 and the surfaces 42, 44, and so that the part of hair is releasably fixed relative to the handle 12 and the protecting sleeve 28 of the hair curler 10. Upon rotation of the handle 12 with the heating barrel 20 generally about the longitudinal axis A-A of the hair curler 10, the tress of hair is drawn through the slot 32 to wind onto the heating barrel 20, such that the tress of hair is wound around the heating barrel 20 in a generally helical manner.

The hair curler 10 may then be activated to heat up the electric heater 40 so as to heat up the heating barrel 20, to thereby heat the tress of hair wound around the heating barrel 20, for curling or styling purposes. Because of the protecting sleeve 28, the danger of the heating barrel 20 coming into contact with the user's hand or the scalp of the person whose hair is being styled or curled is significantly reduced. In addition, as the protecting sleeve 28 is spaced apart from the heating barrel 20, the space between the protecting sleeve 28 and the heating barrel 20 serves to retain some heat, thus shortening the operating time, enhancing the styling and curling efficiency, and providing a uniform and even styling and curling effect.

Figure 28:
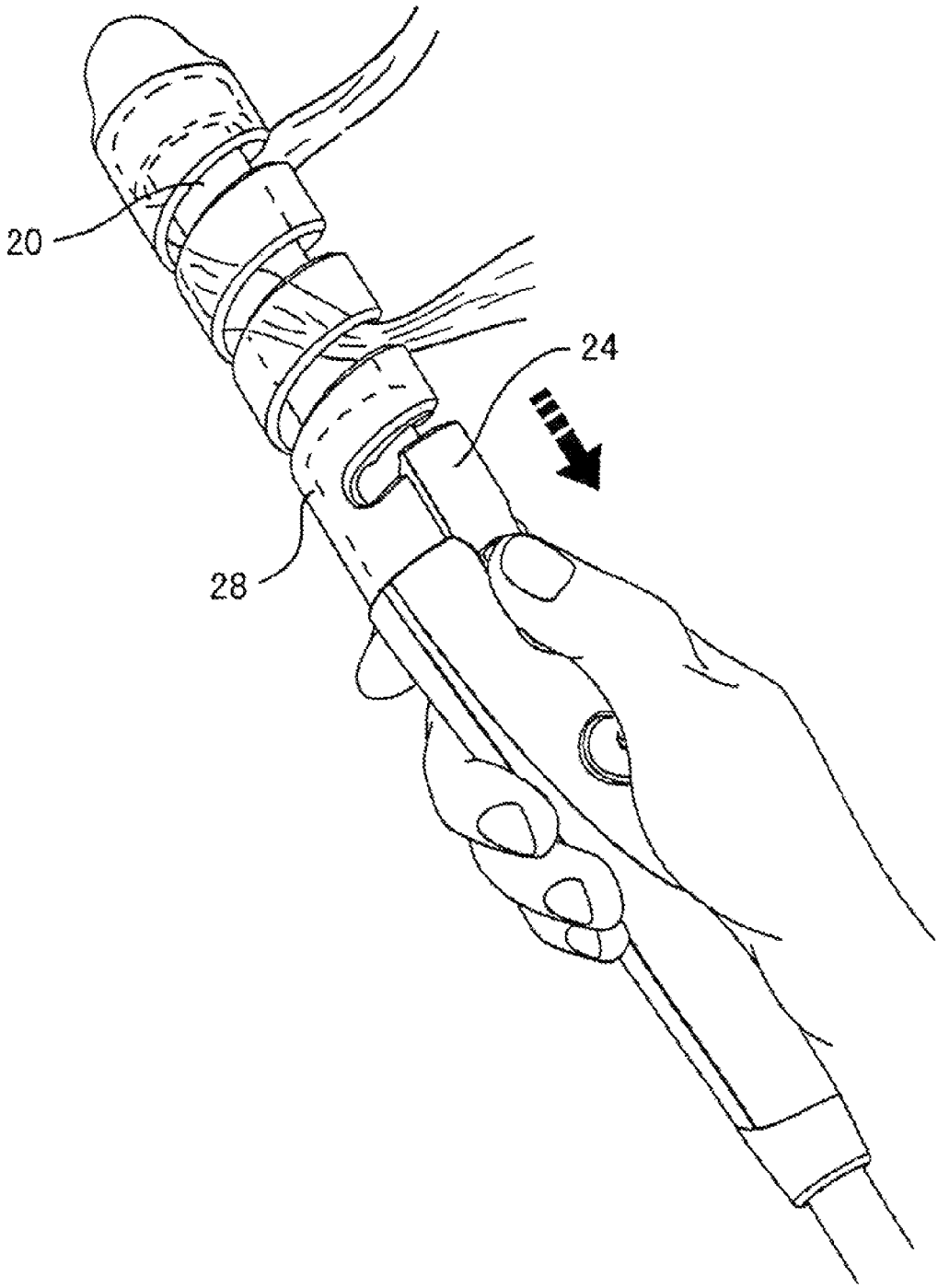
FIG. 28 shows a step of releasing said tress of hair from the apparatus of FIG. 15.

To release the tress of hair from the electric hair curler 10, the sliding lock 24 is again moved away from the protecting sleeve 28, as shown in FIG. 28. The tress of hair may then be pulled away from the heating barrel 20, or the hair curler 10 may be moved away from the tress of hair.

It should be understood that the above only illustrates an example whereby the present invention may be carried out, and that various modifications and/or alterations may be made thereto without departing from the spirit of the invention. It should also be understood that various features of the invention which are, for brevity, described here in the context of a single embodiment, may be provided separately or in any appropriate sub-combination.

The invention claimed is:

1. A hair styling apparatus comprising:

at least one heating member having a continuous cylindrical outer surface, the heating member heated to a temperature sufficient to style or curl hair;

at least one protecting sleeve member covering part of said heating member, said sleeve member being spaced away from and out of contact with said heating member, said sleeve member including a wall member with at least one helical slot configured for allowing a tress of hair to pass therethrough, the tress of hair crossing the space between the sleeve member and the heating member, for entering into direct contact with said heating member, said protecting sleeve member preventing direct contact of the heating member with the hands or scalp of a user.

2. The apparatus according to claim 1 wherein said sleeve member is in a general shape of a hollow cylinder.

3. The apparatus of claim 1 wherein said helical slot curves along a majority of the length of said sleeve member.

4. The apparatus of claim 1 wherein said sleeve member is made of a polycarbonate plastic.

5. The apparatus of claim 1 wherein said sleeve member is made of a non-opaque material.

6. The apparatus of claim 1 further comprising a lock member and at least one abutment surface, for releasably fixing part of a tress of hair relative to said sleeve member, wherein said lock member is movable between a first position in which said lock member is in contact with said abutment surface and a second position in which said lock member is out of contact with said abutment surface.

7. The apparatus according to claim 6 wherein said lock member is biased towards said first position.

8. The apparatus according to claim 1 wherein said sleeve member is fixed relative to said heating member.

9. A hair styling method comprising:

(a) providing a hair styling apparatus with at least one heating member having a cylindrical continuous outer surface and operated at a temperature sufficient to curl or style hair, and at least one protecting sleeve member covering part of said heating member, said protecting sleeve member being out of contact with said heating member and spaced therefrom, said protecting sleeve member preventing direct contact of the heating member with the hands or scalp of a user, wherein said sleeve member includes a wall member with at least one helical slot configured for allowing a tress of hair to pass therethrough, the tress of hair crossing the space between the sleeve member and the heating member, for entering into direct contact with said heating member;

(b) engaging a tress of hair with said hair styling apparatus; and (c) rotating said hair styling apparatus to draw said tress of hair through said helical slot, said tress of hair crossing the space between the sleeve and the heating member, thereby contacting said tress of hair with the heating member operated at the temperature sufficient to curl or style hair.

10. The method according to claim 9 further characterized in that in said step (b), part of said tress of hair is releasably fixed relative to said sleeve member.

11. The method according to claim 10 wherein said part of said tress of hair is releasably fixed between a lock member and at least one abutment surface of said hair styling apparatus.

12. The method according to claim 11 further comprising moving said lock member away from said abutment surface, placing said part of said tress of hair in a space between said lock member and said abutment surface, and moving said lock member or allowing said lock member to move towards said abutment surface to releasably fix said part of said tress of hair between said lock member and said abutment surface.

13. The method according to claim 12 further comprising moving said lock member away from said abutment surface, and releasing said tress of hair from said apparatus.

14. The method according to claim 9 wherein in said step (c), said hair styling apparatus is rotated generally about a longitudinal axis of said hair styling apparatus.

15. A hair styling apparatus comprising:

at least one heating member having a continuous cylindrical outer surface, the heating member heated to a temperature sufficient to style or curl hair;

at least one protecting sleeve member covering part of said heating member, said protecting sleeve member configured to prevent direct contact of the heating member with the hands or scalp of a user, and maintained at a temperature less than the temperature of the heated member, said protecting sleeve member including a wall member with at least one helical slot configured for allowing a tress of hair to pass therethrough, the tress of hair entering into direct contact with said heating member operated at the temperature sufficient to style or curl the hair, said protecting sleeve member maintained at the temperature less than the temperature of the heated member preventing damage to the hands or scalp of the user.

16. The apparatus according to claim 15 wherein said sleeve member is spaced apart from said heating member.

17. The apparatus according to claim 15 wherein said sleeve member is in a general shape of a hollow cylinder.

18. The apparatus of claim 15 wherein said helical slot curves along a majority of the length of said sleeve member.

19. The apparatus of claim 15 wherein said sleeve member is made of a polycarbonate plastic.

20. The apparatus of claim 15 further comprising a lock member and at least one abutment surface, for releasably fixing part of a tress of hair relative to said sleeve member, wherein said lock member is movable between a first position in which said lock member is in contact with said abutment surface and a second position in which said lock member is out of contact with said abutment surface.

* * * * *